US006776953B1

(12) United States Patent
Hulsberg et al.

(10) Patent No.: US 6,776,953 B1
(45) Date of Patent: Aug. 17, 2004

(54) METHOD AND DEVICE FOR FORMING A HOLLOW BODY

(75) Inventors: Thomas Hulsberg, Buchholz (DE); Thorsten Sternal, Moisburg (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/763,974

(22) PCT Filed: Jul. 14, 1999

(86) PCT No.: PCT/EP99/04960

§ 371 (c)(1),
(2), (4) Date: May 31, 2001

(87) PCT Pub. No.: WO00/12241

PCT Pub. Date: Mar. 9, 2000

(30) Foreign Application Priority Data

Aug. 29, 1998 (DE) ..... 198 39 526

(51) Int. Cl.[7] ..... B29D 23/00

(52) U.S. Cl. ..... 264/570; 264/573; 425/522; 72/57; 72/58; 72/61; 72/62

(58) Field of Search ..... 264/570, 573; 425/522; 72/57, 58, 61, 62

(56) References Cited

U.S. PATENT DOCUMENTS 2,777,500 A * 1/1957 Carl et al. ..... 72/57

5,339,670 A * 8/1994 Granelli ..... 72/152

FOREIGN PATENT DOCUMENTS

| | | |
|---|---|---|
| DE | 44 28 564 A1 | 6/1995 |
| EP | 0 414 545 A2 | 2/1991 |
| EP | 0 621 091 A1 | 10/1994 |
| FR | 814151 | 5/1959 |

* cited by examiner

*Primary Examiner*—Suzanne E. McDowell
(74) *Attorney, Agent, or Firm*—Crowell & Moring LLP

(57) ABSTRACT

The invention relates to a process and apparatus for the forming of a hollow body. The process includes providing a forming mold comprising an upper mold and a lower mold which form a mold cavity having a cross-sectional contour in a closed state of the forming mold. The upper mold includes a roller. The hollow body is placed between the upper mold and the lower mold in an area of the mold cavity. The hollow body is preprofiled by moving at least one of the upper mold and the lower mold into the closed state at which time the roller comes into frictional contact with a surface of the hollow body running at an acute angle with respect to a direction of the movement of the at least one upper mold and lower mold. The preprofiled hollow body is then formed into a final shape corresponding to the cross-sectional contour of the forming mold by applying a hydraulic internal pressure into the preprofiled hollow body and expanding the hollow body while the upper mild and the lower mold are in the closed state. By way of the present invention, a hollow body can be reliably formed while significantly reducing the stress on the hollow body.

8 Claims, 4 Drawing Sheets

METHOD AND DEVICE FOR FORMING A HOLLOW BODY

BACKGROUND AND SUMMARY OF THE INVENTION

The invention relates to a process for the forming of a hollow body and to an apparatus for carrying out the same.

A process of the generic type is known from EP 0 621 091 A1. In this case, a pre-bent tubular hollow body which is straight in the vertical plane and has a circular cross section is placed horizontally into an internal high-pressure forming mold—which is divided into an upper die and a lower die. In the closed position of the forming mold, the upper die forms with the lower die a mold cavity which has a polygonal cross section. Once the hollow body has been positioned, the forming mold is closed, the hollow body being squeezed together frontally during the lowering movement of the upper die in such a way that the hollow body assumes a contour roughly approximating the contour of the mold cavity and is consequently preprofiled. The hollow body is subsequently filled with a high-pressure fluid and, after an internal high-pressure has been exerted by means of the fluid, is expanded until the walls of the hollow body come to bear against the walls of the mold cavity in a form that is largely true to the contours. If, however, the hollow body has surfaces which run at an acute angle with respect to the lowering direction of the upper die and the surfaces come into frictional contact while the operation of closing the mold is still in progress, i.e. during the lowering movement of the upper die, very high friction occurs between the hollow body and the upper die during the profiling of the said surfaces until the closed position of the forming mold is reached. The friction caused as a result has the effect that the material of the hollow body is pulled apart disproportionately there, so that the thickness of the sheet metal is reduced, or a thinning of the material occurs, which may result in cracks occurring even during the preprofiling operation. In any event, the subsequent final forming by means of internal high pressure leads to bursting of the hollow body on account of the weakening of the material of the preprofiled hollow body shape. Consequently, it is not ensured that a hollow body of this type can be produced by a dependable process.

The invention is based on the object of developing a process for dependably producing a hollow body which, as a blank, has surfaces which run at an acute angle with respect to the lowering direction of the upper die and which come into frictional contact with the latter during the preprofiling. Furthermore, an apparatus with which this hollow body can be produced is to be presented.

As a result of the invention, the friction which occurs between the mold and the hollow body to be preprofiled is absorbed as rolling friction by the roller, whereby the frictional energy does not act on the hollow body but is displaced away from the latter to the mold or the upper die. There, the frictional energy is converted into rotational kinetic energy. For this reason, the stressing of the hollow body caused by the upper die during preprofiling at the critical locations, that is the surfaces running at an acute angle with respect to the lowering direction of the upper die, is significantly reduced, so that thinning of the material, which puts the process at risk, does not occur. Consequently, even hollow bodies of a geometrically complicated shape, without an identifiable symmetry, can be formed into a profiled shape in a reliable process by the process according to invention and with the apparatus according to the invention.

Other objects, advantages and novel features of the present invention will become apparent from the following detailed description of the invention when considered in conjunction with the accompanying drawings.

DETAILED DESCRIPTION OF THE DRAWINGS

Figure 1:
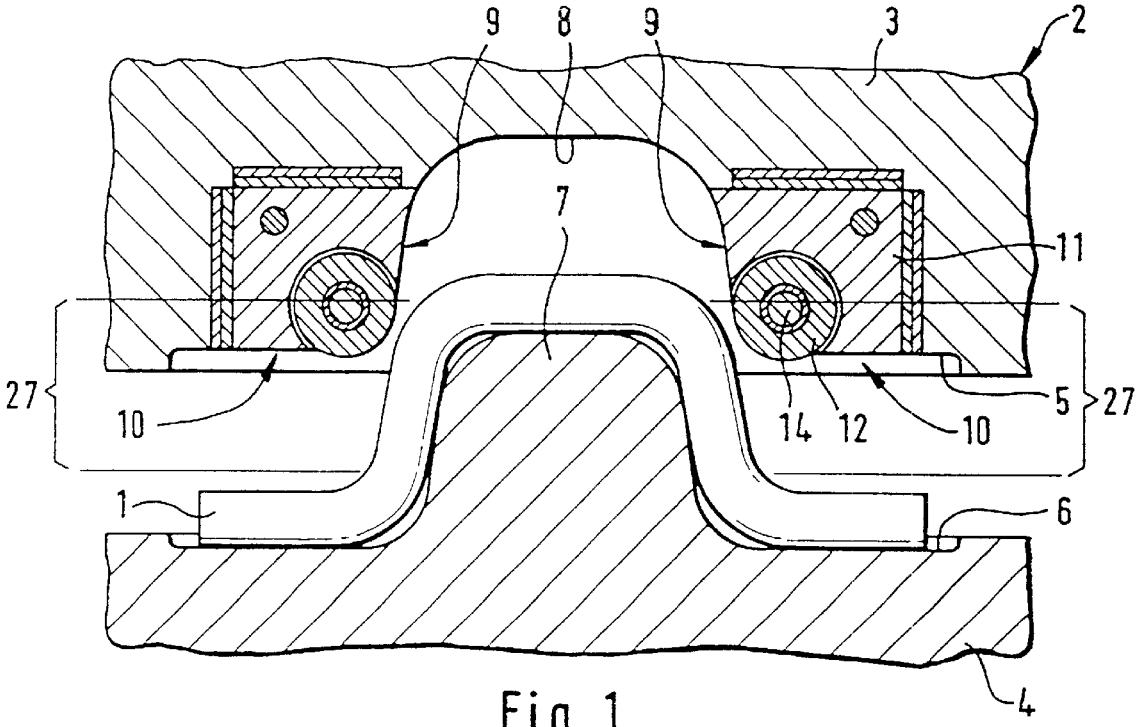
FIG. 1 shows in a lateral longitudinal section the apparatus according to the invention with the forming mold open, in the in-use position of the roller and with the placed-in hollow body in the non-preprofiled state.

Represented in FIG. 1 is a hollow body 1, which in the form of a tube of circular cross section bent in a meandering form is placed into an internal high-pressure forming mold 2. The internal-pressure forming mold 2 is divided into a linearly displaceable upper die 3 and a lower die 4, the cuts 5, 6 of which form in the closed state of the forming mold a mold cavity for the hollow body 1 to be formed. The lower die 4 has a prominence 7 which is of a similar shape to the meander of the hollow body 1, over which a portion of the cut 6 is led and around which the hollow body 1 extends with its meander, partially bearing against this portion of the cut. The upper die 3 contains a recess 8, which in rough approximation is the negative shape of the meander, in which the counterpart of the portion of the cut of the prominence 7 runs in a way corresponding to the profile of the portion of the cut and which is fitted over the latter in the closed position of the forming mold 2.

Figure 2:
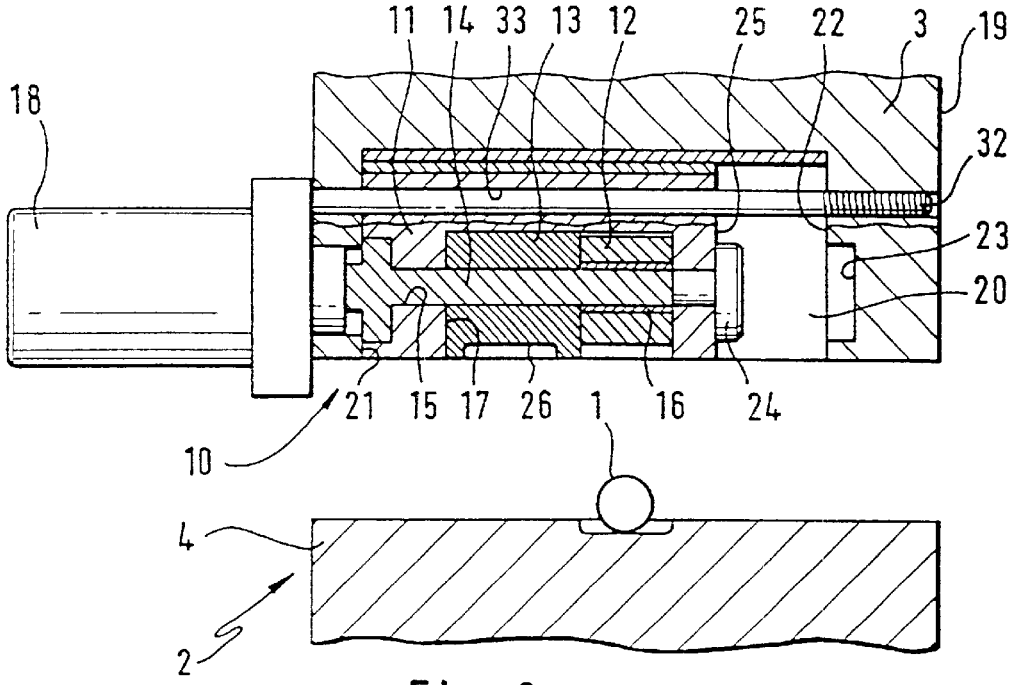
FIG. 2 shows the apparatus from FIG. 1 in a cross section.

Respectively arranged in the end regions 9 of the recess 8 there is a mold module 10, which is movable transversely with respect to the said recess and comprises an upper die segment 11, a roller 12, a female die element 13 and a spindle 14 (FIG. 2). The segment 11 has an axial through-bore 15, in which the spindle 14 is held. The spindle 14 bears the female die element 13, which is fastened to it in a rotationally fixed manner, and the roller 12, which axially adjoins the female die element 13 directly and is mounted rotatably on the spindle 14 by a sliding bearing 16. The segment 11 has for this purpose a receiving chamber 17, which is open towards the lower die 4 and is passed through axially by the spindle 14. The spindle 14 is designed as a piston rod of a control cylinder 18, which is screwed onto the outer side 19 of the upper die 3 and by means of which the mold module 10 can be driven movably back and forth in the axial direction.

Arranged for this purpose in the upper die 3 is a displacing space 20, which is likewise open towards the lower die 4 and in which the elongated mold module 10 is held axially displaceably between two defined stops. The one stop is formed by the end wall 21 of the displacing space 20 on the control cylinder side and the other stop is formed by the end wall 22 of the displacing space 20 remote from the control cylinder. The end wall 22 has a circular centering receptacle 23, which is assigned to a centering plate 24 which is in bearing contact on the side 25 of the segment 11 remote from the control cylinder 18 and is connected to the piston rod or forms the termination there of the spindle 14. The fastening screw 32 of the control cylinder 18 passes both through an axial bore 33 at the edge of the upper die segment 11 and through the displacing space 20, and consequently also serves as an additional retaining and guiding means for the mold module 10 and in particular as a weight-relieving means for the spindle 14.

While in the female die element 13 there is formed a cut part 26 which, in the closed state, at this location forms with the cut 6 the exact contour of the approximately rectangular mold cavity for the concluding internal-pressure forming, the outside diameter of the roller 12 is chosen such that it encloses with the cut 6 of the lower die 4 a space in which the hollow body can assume a preform roughly approximated to the final shape, and consequently a suitable preprofiling can take place.

For the preprofiling, the upper die 3 is lowered onto the lower die 4. During the lowering movement, the upper die 3 comes into frictional contact via the end regions 9 of its recess 8 with surfaces 27 of the hollow body 1 which run at an acute angle with respect to the lowering direction of the upper die 3. In this embodiment, these surfaces are the surfaces of the bending contours of the hollow body 1. Before the upper die 3 is acted on, the control cylinder 18 drives the mold module 10 in such a way that its end face 28 facing the cylinder 18 bears against the end face 21 of the displacing space 20. This stop position thereby defines the preprofiling position of the roller 12. Therefore, during the frictional contact of the end regions 9, only the roller 12 comes into direct contact with the surfaces 27 of the hollow body 1. At the same time, the female die element 13 assumes a not-in-use position.

Figure 3:
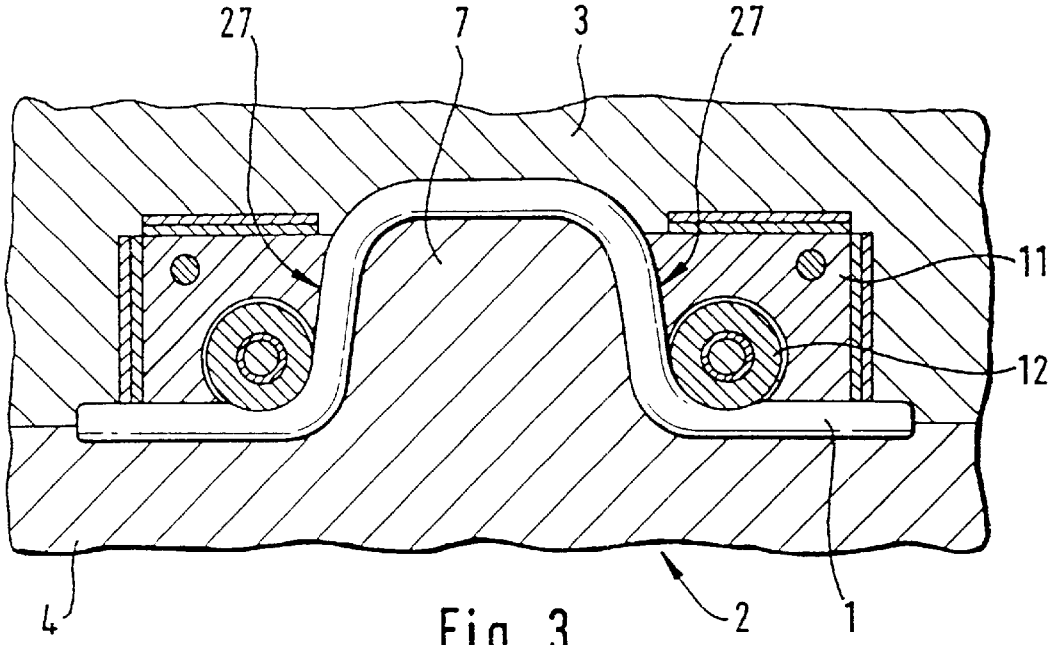
FIG. 3 shows in a lateral longitudinal section the apparatus according to the invention from FIG. 1 in the closed position of the forming mold with a preprofiled hollow body.
Figure 4:
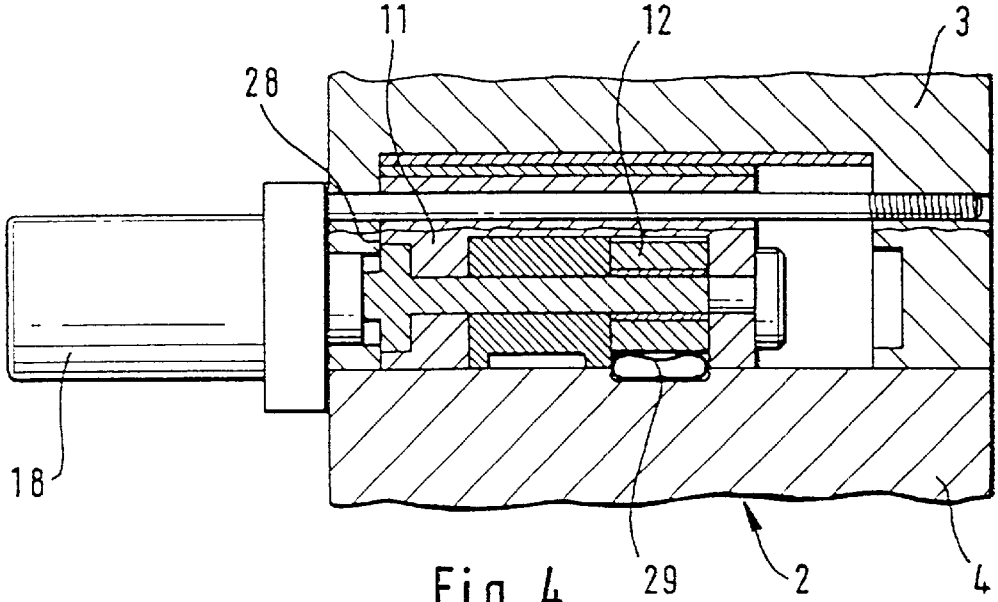
FIG. 4 shows the apparatus from FIG. 3 in a cross section.

With the lowering movement, the roller 12 on the one hand squeezes the hollow body 1 in the region of the surfaces 27, but at the same time rolls on them in a friction-reducing manner. The remaining unbent portions of the hollow body 1 are preprofiled in this squeezing manner by the regions of the upper die 3 adjoining the upper die segment 11. The preprofiling of the hollow body 1 by the roller 12 and the adjoining regions of the upper die 3 is ended in the closed position of the forming mold 2 (FIG. 3 and FIG. 4). In contrast to its initial shape with a circular cross section, the hollow body 1 now has a crushed preform 29, roughly approximated to the final rectangular cross-sectional shape. The hollow body 1 is, moreover, pressed by the upper die 3 and by the roller 12 integrated in the latter completely against the prominence 7 in a way corresponding to the contour of the lower die 4.

It should be noted that the hollow body 1 does not have to be preprofiled continuously over its entire extent. It may also be partially squeezed. What is important, however, is that wherever the upper die 3 comes into frictional contact with surfaces 27 of the hollow body 1 running at an acute angle with respect to its lowering movement, a roller 12 is arranged for acting on the body. The hollow body 1 does not in this case necessarily require a bending shape, but may be irregularly contoured, for example in a corrugated manner, on its surface facing the upper die 3.

Figure 5:
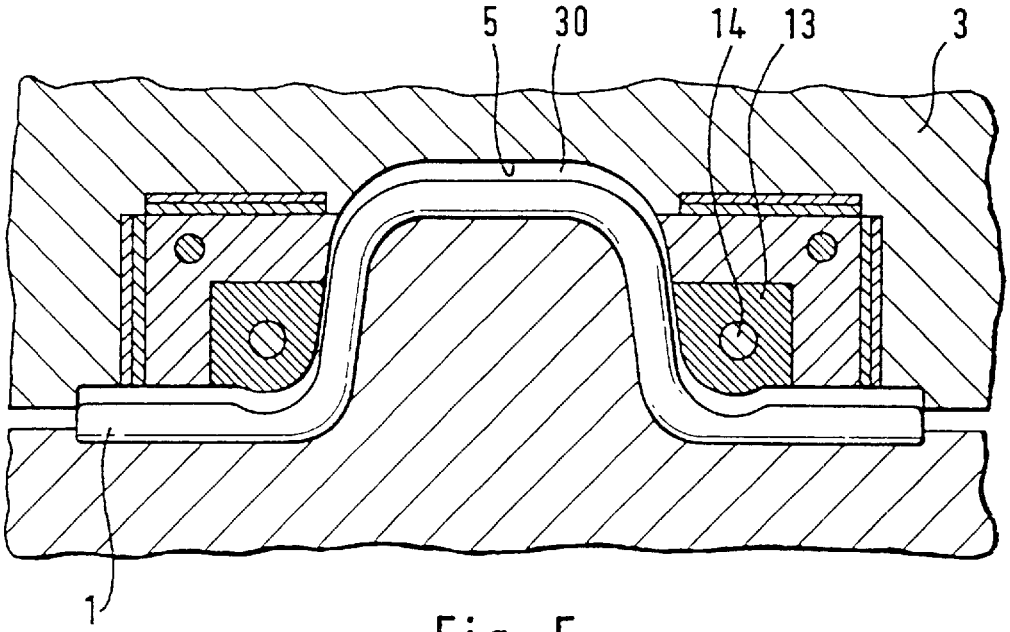
FIG. 5 shows in a lateral longitudinal section the apparatus according to the invention from FIG. 1 with the forming mold open, in the in-use position of the female die element and with a preprofiled hollow body.
Figure 6:
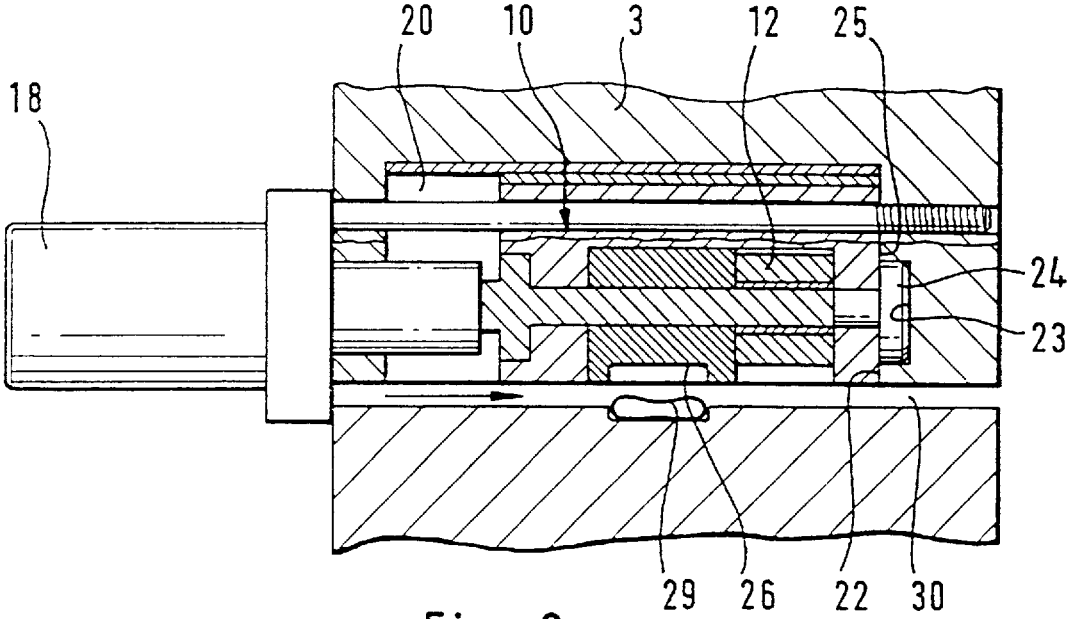
FIG. 6 shows the apparatus from FIG. 5 in a cross section.

After the preprofiling, the upper die 3 is raised slightly, so that a gap 30 is formed between the roller 12 or the mold module 10 and the preprofiled hollow body 1, as can be seen from FIGS. 5 and 6. Then, the control cylinder 18 drives the mold module 10 in a way corresponding to the direction of the arrow in such a manner that said module comes to lie with the side 25 of the segment 11 remote from the control cylinder 18 against the end wall 22 of the displacing space 20, the centering plate 24 being accommodated in the centering receptacle 23 of the end wall 22. The mold module 10 is consequently centered and also radially held in its drawn-out position. This position of the mold module 10 defines the fitting position of the cut part 26 of the female die element 13 into the remaining cut 5 of the upper die 3, the roller 12 then lying in a not-in-use position.

Figure 7:
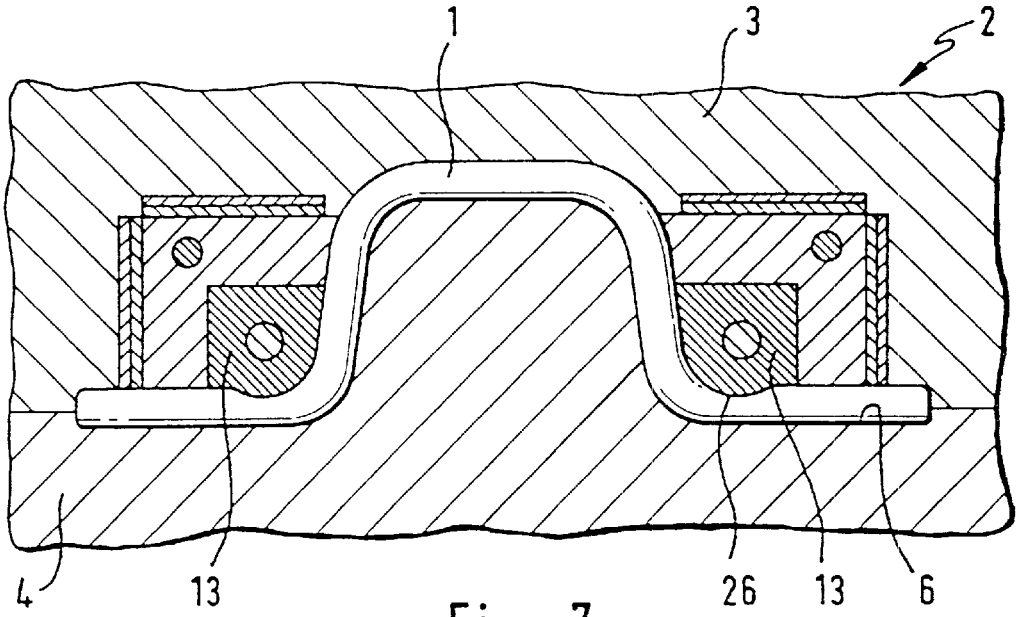
FIG. 7 shows in a lateral longitudinal section the apparatus according to the invention from FIG. 5 in the closed position of the forming mold after internal high-pressure forming of the hollow body.
Figure 8:
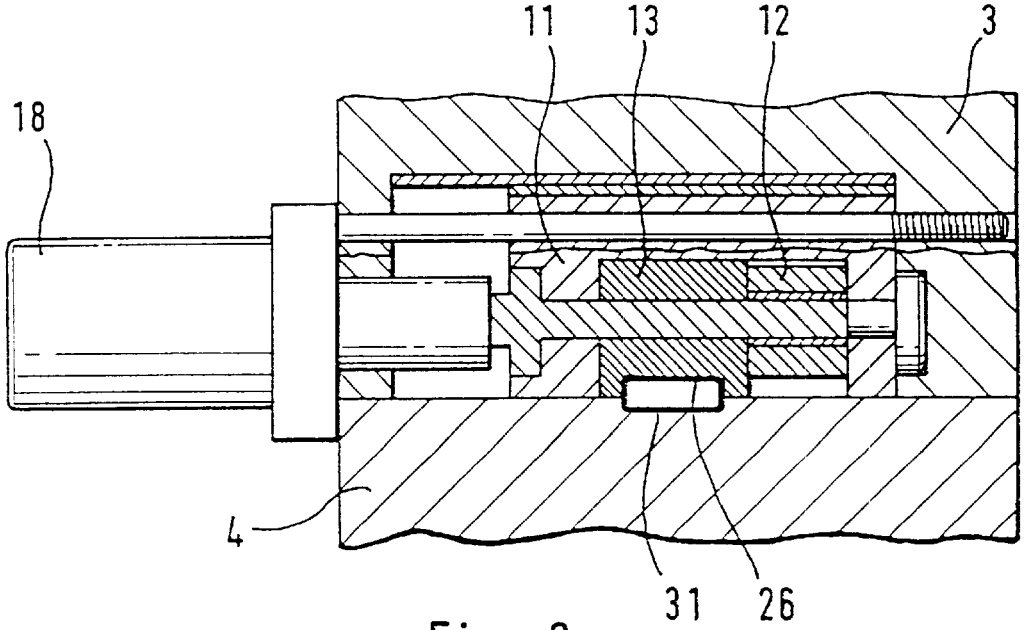
FIG. 8 shows the apparatus from FIG. 7 in a cross section.

After that, the forming mold 2 is closed again, the cut part 26 of the female die element 13, which has being brought into the in-use position, forming with the cut 6 of the lower die 4 a mold cavity portion for the desired end contour of the hollow body 1. The hollow body 1 is subsequently filled with a high-pressure fluid, is sealed off in a suitable way at both ends and the fluid is pressurized by a high-pressure generating system. On account of the internal high pressure thereby produced, the hollow body 1 is expanded, it walls coming to lie against those of the mold cavity in a form that is true to the contours to achieve the final shape 31 (FIGS. 7 and 8).

It is conceivable within the scope of the invention to use for the preprofiling operation a forming mold that is separate from the internal high-pressure forming mold 2, so that the forming apparatus comprises two forming molds and not—in the way described above—a single forming mold with integration of the functional properties of two forming molds, in the latter case the upper die 3 being identical to the upper mold and the lower die 4 being identical to the lower mold of the internal-pressure forming mold 2. Although this configuration is less economical in terms of the process than the use of a single mold for preprofiling and for allowing the preprofiled workpiece to be formed into the finished state by means of internal high pressure, with a separate preprofiling mold on the one hand it is not necessary for the surface quality of the cut to meet high requirements, which makes the production of the mold less expensive and easier, and as a consequence of which minor damage to the cut occurring during preprofiling or wearing of the cut is entirely unimportant for the overall forming operation, and on the other hand the extremely high-quality surface of the cut of the internal-pressure forming mold is spared, since it is not used for applying mechanical force in the preprofiling squeezing operation.

Furthermore, instead of the displaceable mold module 10, it is conceivable to provide a female die element 13 or a roller 12 which is releasably fastened to the upper die 3 and is axially immovable, the female die element 13 being exchanged for the roller 12 as and when required. This possibility also does not serve to make the process sequence as quick as possible, but does away with the control function, the control cylinder 18 and the segment 11, making the overall forming apparatus more simple.

Finally, it is conceivable for the surfaces 27 running at an acute angle with respect to the lowering direction of the upper die 3 not to be produced until the closing movement of the upper die 3 takes place, the hollow body blank being shaped with straight lines in its initial form and not having any discontinuities with respect to the profile of its surface and coming to lie horizontally in the forming mold 2. This makes it possible in a simple way for three forming techniques that are different from one another to be executed in a single forming mold 2 with a single cut. In this case, profile shaping and preprofiling of the hollow body 1 are simultaneously accomplished in a single operation.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Process of forming a hollow body comprising:

providing a forming mold comprising an upper mold and a lower mold, the upper mold and the lower mold forming a mold cavity having a cross-sectional contour in a closed state of the forming mold, and the upper mold comprising a roller;

placing the hollow body between the upper mold and the lower mold in an area of the mold cavity;

preprofiling the hollow body by moving at least one of the upper mold and the lower mold into the closed state whereby the roller comes into frictional contact with a surface of the hollow body running at an acute angle with respect to a direction of movement of the at least one upper mold and lower mold; and forming the preprofiled hollow body into a final shape corresponding to the cross-sectional contour of the forming mold by applying a hydraulic internal pressure into the preprofiled hollow body and expanding the hollow body while the upper mold and the lower mold are in the closed state.

2. The process of forming a hollow body according to claim 1, wherein the roller is exchanged for a rotationally fixed female die element before the forming of the preprofiled hollow body into the final shape, the rotationally fixed female die element comprising a cut part forming a part of the mold cavity in the closed state of the upper mold and the lower mold.

3. The process of forming a hollow body according to claim 1, wherein the surfaces of the hollow body running at an acute angle, with respect to a direction of movement of the at least one upper mold and lower mold, extend from a straight, horizontally lying portion of the hollow body and are formed during preprofiling.

4. An apparatus for forming a hollow body comprising:

a forming mold comprising an upper mold and a lower mold, the upper mold and the lower mold comprising cuts forming a mold cavity for a hollow body, the mold cavity having a cross-sectional contour in a closed state of the forming mold;

wherein the upper mold comprises a spindle and a rotatable roller which are arranged transversely with respect to a direction of movement of at least one of the upper mold and the lower mold, the rotatable roller being arranged such that, during a preprofiling, the upper mold and the lower mold are movable toward each other such that the roller is capable of coming into frictional contact with a surface of the hollow body which runs at an acute angle with respect to the direction of movement of the molds to form the hollow body into a preform; and an internal high-pressure forming mold comprising an upper die and a lower die which form a mold cavity having a cross-sectional contour which corresponds to a final shape of the hollow body and capable of providing a pressurized high-pressure fluid to the hollow body to achieve the final shape.

5. An apparatus for forming a hollow body according to claim 4, wherein the upper mold and the lower mold of the forming mold and the upper die and the lower die of the internal high-pressure forming mold correspond to the same structure, and the upper mold includes a rotationally fixed female die element forming a cut part of the cut of the internal high-pressure forming mold which corresponds to the final shape of the hollow body to be formed, the female die element being arranged to replace the roller.

6. An apparatus for forming a hollow body according to claim 5, wherein the roller is arranged in an exchangeable manner in the upper die or in the upper mold.

7. An apparatus for forming a hollow body according to claim 5, wherein the female die element and the roller are mounted together on a spindle which is displaceable between two defined steps, the first step defining a preprofiling position of the roller and the second step defining a fitting position of the cut part of the female die element into a remaining cut of the upper die.

8. An apparatus for forming a hollow body according to claim 7, wherein the spindle is actuable in an axial direction by a control cylinder fastened on an outer side of the upper die or the upper mold.

* * * * *